US011041509B2

(12) United States Patent
Cao et al.

(10) Patent No.: US 11,041,509 B2
(45) Date of Patent: Jun. 22, 2021

(54) HEIGHT-ADJUSTABLE FAN FIXING STRUCTURE AND HEIGHT ADJUSTMENT METHOD FOR FAN MODULE

(71) Applicant: ZHENGZHOU YUNHAI INFORMATION TECHNOLOGY CO., LTD., Henan (CN)

(72) Inventors: Zhencai Cao, Henan (CN); Jie Yang, Henan (CN); Xiaozheng Li, Henan (CN)

(73) Assignee: ZHENGZHOU YUNHAI INFORMATION TECHNOLOGY CO., LTD., Henan (CN)

( * ) Notice: Subject to any disclaimer, the term of this patent is extended or adjusted under 35 U.S.C. 154(b) by 97 days.

(21) Appl. No.: 16/475,090

(22) PCT Filed: Dec. 28, 2017

(86) PCT No.: PCT/CN2017/119301
§ 371 (c)(1),
(2) Date: Jun. 29, 2019

(87) PCT Pub. No.: WO2019/024410
PCT Pub. Date: Feb. 7, 2019

(65) Prior Publication Data

US 2019/0331133 A1 Oct. 31, 2019

(30) Foreign Application Priority Data

Jul. 31, 2017 (CN) ..... 201710639973.3

(51) Int. Cl.
*F04D 29/52* (2006.01)
*F04D 29/64* (2006.01)
(Continued)

(52) U.S. Cl.
CPC ..... *F04D 29/646* (2013.01); *F04D 29/002* (2013.01); *F04D 29/403* (2013.01);
(Continued)

(58) Field of Classification Search
CPC .... F04D 29/403; F04D 29/522; F04D 29/644; F04D 29/646; H05K 7/20172
See application file for complete search history.

(56) References Cited

U.S. PATENT DOCUMENTS 5,721,670 A * 2/1998 Cochrane ..... H05K 7/20172 165/80.3
6,190,140 B1 2/2001 Matson
(Continued)

FOREIGN PATENT DOCUMENTS

CN 2375795 Y 4/2000
CN 2714860 Y 8/2005
(Continued)

OTHER PUBLICATIONS

International Search Report for PCT/CN2017/119301 dated Apr. 20, 2018, ISA/CN.

*Primary Examiner* — Ninh H. Nguyen
(74) *Attorney, Agent, or Firm* — Yue (Robert) Xu; Apex Attorneys at Law, LLP

(57) ABSTRACT

A height-adjustable fan fixing structure and a height adjustment method are provided. The height-adjustable fan fixing structure includes a fan box rear cover and a fan box front cover, the fan box rear cover and the fan box front cover cooperating to fix a fan; and further includes a height adjustment block, the height adjustment block being adjustably mounted on a whole piece formed by connection of the fan box rear cover and the fan box front cover, the lower end of the two side surfaces of the height adjustment block being provided with trunkings, each of the trunkings being provided with a rotatable wire screw, positions, corresponding
(Continued)

to the two ends of each wire screw, on the fan box rear cover and the fan box front cover being provided with clamping holes, the two ends of the wire screw being inserted into the clamping holes.

10 Claims, 8 Drawing Sheets

(51) Int. Cl.
*F04D 29/00* (2006.01)
*F04D 29/40* (2006.01)
*F04D 29/66* (2006.01)

(52) U.S. Cl.
CPC ..... *F04D 29/522* (2013.01); *F04D 29/644* (2013.01); *F04D 29/668* (2013.01)

(56) References Cited

U.S. PATENT DOCUMENTS 6,556,437 B1 * 4/2003 Hardin ..... H05K 7/20172 361/679.48
7,177,150 B2 * 2/2007 Kazuhiro ..... F04D 29/601 248/676
8,547,693 B2 * 10/2013 Chen ..... G06F 1/183 361/679.5
2008/0286135 A1 11/2008 Yoshida et al.

FOREIGN PATENT DOCUMENTS

CN 101008405 A 8/2007
CN 201115123 Y 9/2008
CN 205779251 U 12/2016
CN 107387449 A 11/2017

* cited by examiner

HEIGHT-ADJUSTABLE FAN FIXING STRUCTURE AND HEIGHT ADJUSTMENT METHOD FOR FAN MODULE

The application is a National Phase entry of PCT Application No. PCT/CN2017/119301, filed on Dec. 28, 2017, which claims the priority to Chinese patent application No. 201710639973.3 titled "HEIGHT-ADJUSTABLE FAN FIXING STRUCTURE AND HEIGHT ADJUSTMENT METHOD FOR FAN MODULE", filed with the China National Intellectual Property Administration on Jul. 31, 2017, which are incorporated herein by reference in their entireties.

FIELD

The present application relates to the technical field of fan fixing, and in particular to a height adjustable fan fixing structure and a method for adjusting the height of the fan module.

BACKGROUND

For a server and memory product, an interior of a chassis is mostly cooled by air. As a key heat dissipating component, a fan is widely used for system cooling, and heat generated by the server and the memory during operation is taken out of the chassis by convection, so as to ensure the heat dissipation and normal operation of the whole machine. Once the fan fails, the heat cannot be dissipated to the outside of the chassis in time, and the temperature of the CPU or the key component will rise, causing a shutting down risk to the system.

The profile specification of the fan commonly used in the server and memory product is 40 mm×40 mm, 60 mm×60 mm, 80 mm×80 mm, and 120 mm×120 mm, in which 60 mm×60 mm and 80 mm×80 mm fans are widely used in 2U, 3U, 4U products. The height position of the fan varies according to the layout of the whole machine, therefore the same type fan cannot be used in a general range of different height scenarios due to different fixing structure forms.

SUMMARY

An object of the present application is to solve the above problems. A height adjustable fan fixing structure and a method for adjusting the height of a fan module are provided, which can achieve hot-plugging and general use of the same type fan in different height scenarios.

The following technology solution is provided according to the present application for solving the above technology problems.

A height adjustable fan fixing structure is provided, which includes a fan box rear cover and a fan box front cover. The fan box rear cover and the fan box front cover are engaged to fix a fan. The structure further includes a height adjusting block, and the height adjusting block is installed on the whole structure after the fan box rear cover and the fan box front cover being connected and is adjustable, a trunking is provided at lower ends of two sides of the height adjusting block, a rotatable wire plug is provided in the trunking, and the fan box rear cover and the fan box front cover are provided with latching holes at positions corresponding to two ends of the wire plug, and the two ends of the wire plug are inserted into the latching holes. The structure further includes a connector fixing seat, and the connector fixing seat is fixed to a connector, and is installed on the fan box rear cover is adjustable.

Further, the fan box rear cover is provided with a buckle, the fan box front cover is provided with a slot at the position corresponding to the buckle, and the buckle is engaged to the slot for fixing.

Further, a damping pad is respectively provided between the fan box rear cover and the fan and between the fan box front cover and the fan, and the damping pad is made of silicone rubber.

Further, the periphery of the height adjusting block is provided with a right angle bending, the right angle bending is engaged with the fan box rear cover and the fan box front cover, the middle of the wire plug is of an arc shape, the two ends of the wire plug are respectively provided with a straight side, and two ends of the straight side are provided with fixing hooks perpendicular to a plane of the wire plug, and the fixing hooks are engaged with the latching holes.

Further, the fan box rear cover is provided with a position scale in a vertical direction.

Further, the height adjusting block is provided with a backflow preventing plate, an upper end of the height adjusting block is provided with a rotating shaft hole, a front end of the backflow preventing plate is provided with a rotatable shaft, and the backflow preventing plate is rotatably connected to the height adjusting block through the rotatable shaft and the rotating shaft hole.

Further, the fan box rear cover is provided with a fixing rail, the connector fixing seat is provided with a fixing sliding groove, the fixing rail cooperates with the fixing sliding groove, an upper end of the connector fixing seat is provided with a position stopping cantilever, the position stopping cantilever is provided with a position stopping buckle, the fixing sliding groove is provided with a position stopping slot in a vertical direction, and the position stopping buckle cooperates the position stopping slot.

Further, the connector fixing seat is made of nylon plus glass fiber PA66+GF material.

A method for adjusting the height of a fan module is provided, which utilizes the above height adjustable fan fixing structure and includes:

S1: loosening the wire plugs on both sides to open it;

S2: pulling up the height adjusting block according to the required height;

S3: upward buckling the wire plugs on both sides after the height adjusting block is in position; and S4: disengaging the position stopping cantilever on the connector fixing seat, and adjusting the height of the connector fixing seat up and down according to the requirement.

Further, in step S2, the height adjusting block is adjusted according to the position scale on the fan box rear cover during the adjustment.

The beneficial effects of the present application are as follows.

1. To solve the problem that the same type fan cannot be used in a general range of different height scenarios due to different fixing structure forms, a height adjusting block is provided according to the present application, which is installed on the whole structure after the fan box rear cover and the fan box front cover being connected and is adjustable. Through the design of the height adjustable hot-plugging fan fixing structure, the operability and the interchangeability of the fan maintenance is increased, the disassembly and assembly are more convenient, and the product maintainability is improved; spare parts are unified, the types of the spare parts are reduced, the cost of opening mold of similar fan boxes is saved, and the competitiveness of the whole machine is improved.

2. In order to achieve the tool-free operation, the trunking is provided at lower ends of the two sides of the height adjusting block, the rotatable wire plug is provided in the trunking, and the fan box rear cover and the fan box front cover are provided with latching holes at positions corresponding to both ends of the wire plug, and the both ends of the wire plug are inserted into the latching holes to achieve screwless and tool-free adjustment, and the operation process is simple.

3. In order to achieve the damping effect, the damping pad is respectively provided between the fan box rear cover and the fan and between the fan box front cover and the fan, and the damping pad is made of silicone rubber. The damping pad can damp the fan to reduce the effects of fan vibration on the system.

Figure 1:
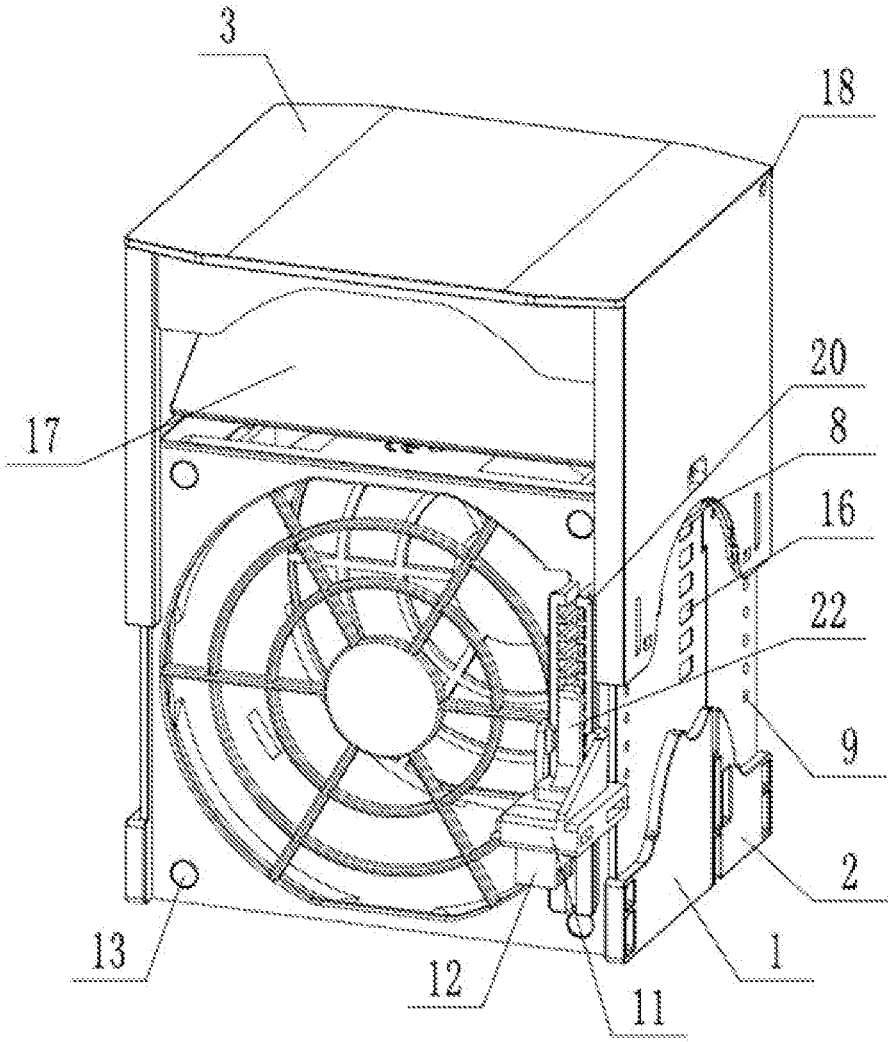
FIG. 1 is a schematic structural view according to the present application.
Figure 2:
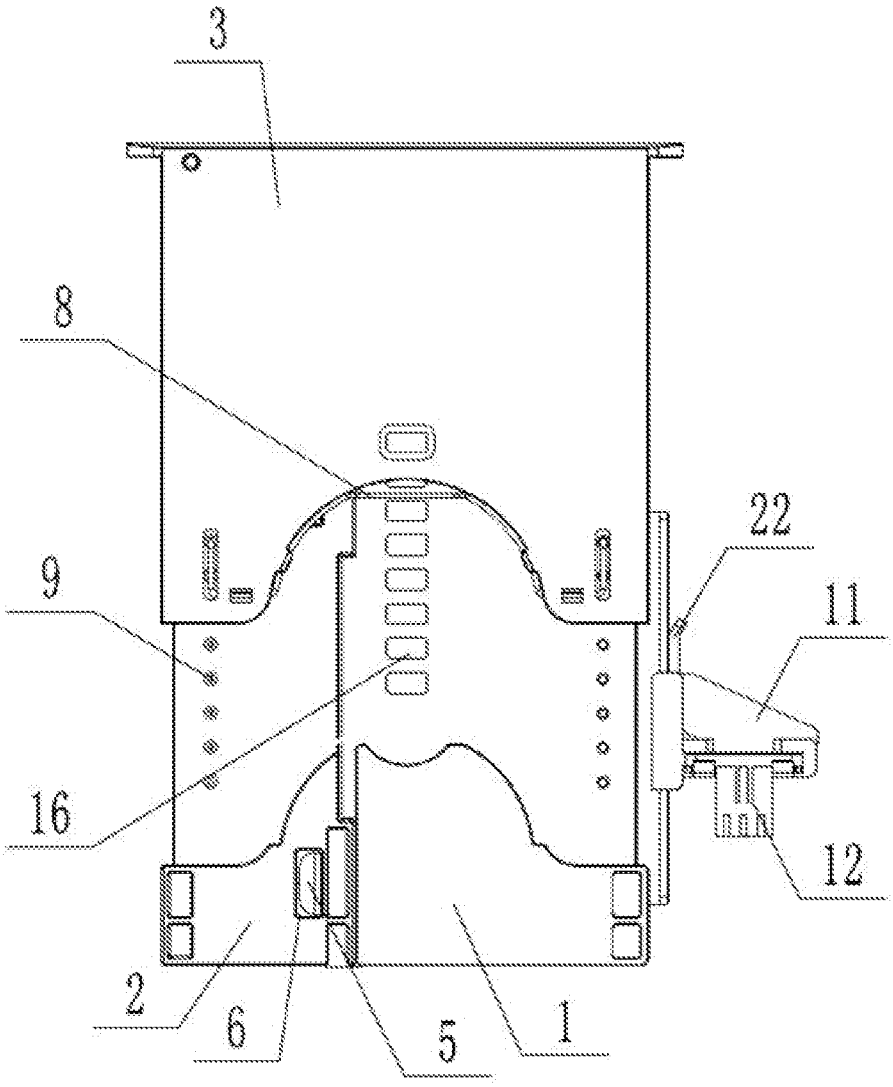
FIG. 2 is a left side view according to the present application.
Figure 3:
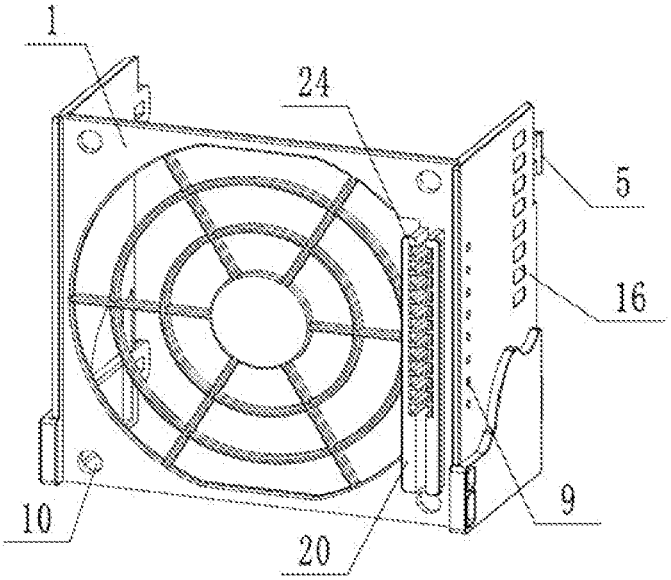
FIG. 3 is a schematic view showing the structure of a fan box rear cover according to the present application.
Figure 4:
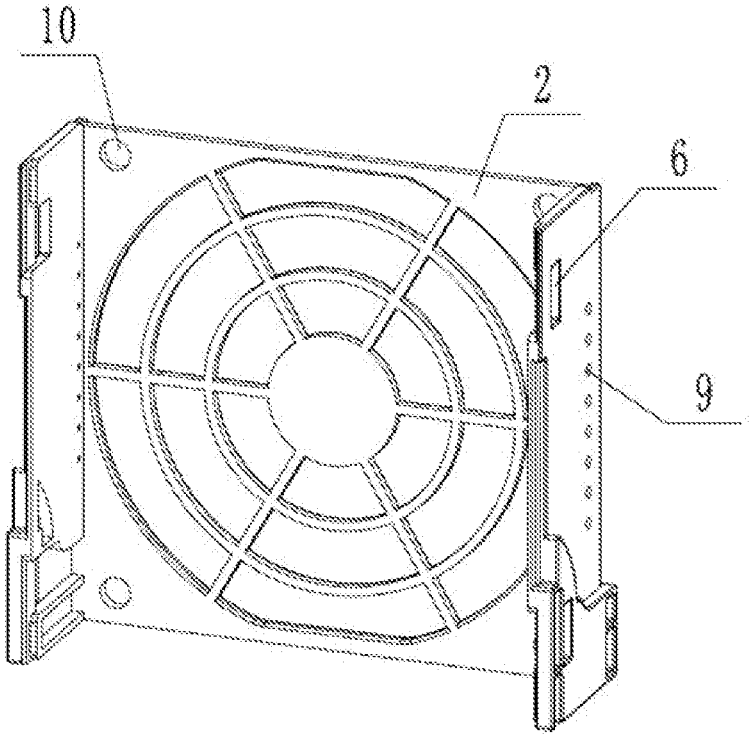
FIG. 4 is a schematic view showing the structure of a fan box front cover according to the present application.
Figure 5:
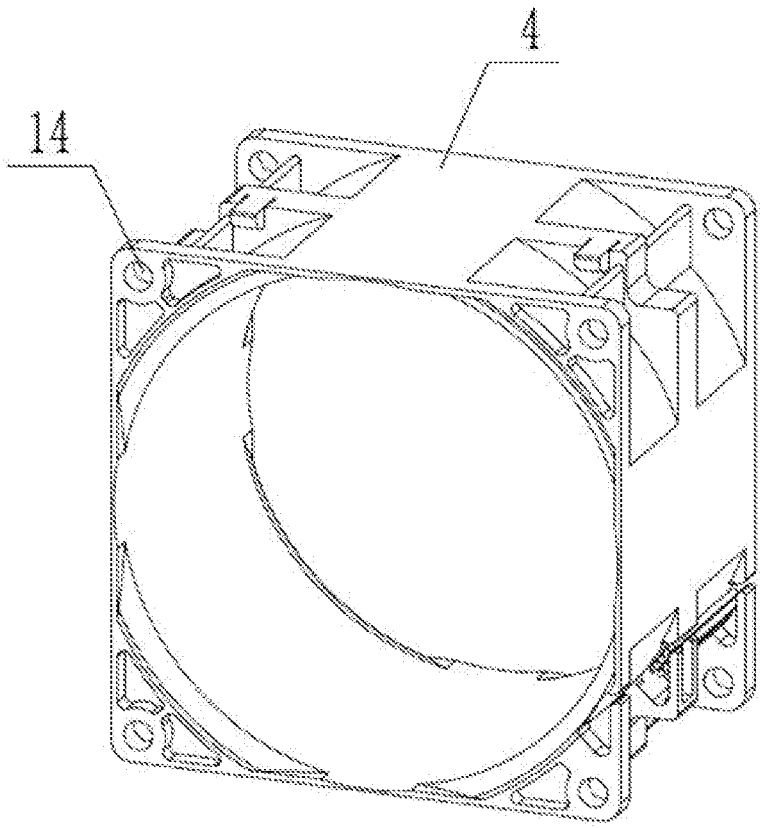
FIG. 5 is a schematic view showing the structure of a fan according to the present application.
Figure 6:
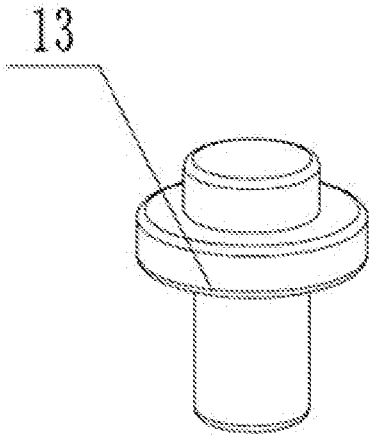
FIG. 6 is a schematic view showing the structure of a damping pad according to the present application.
Figure 7:
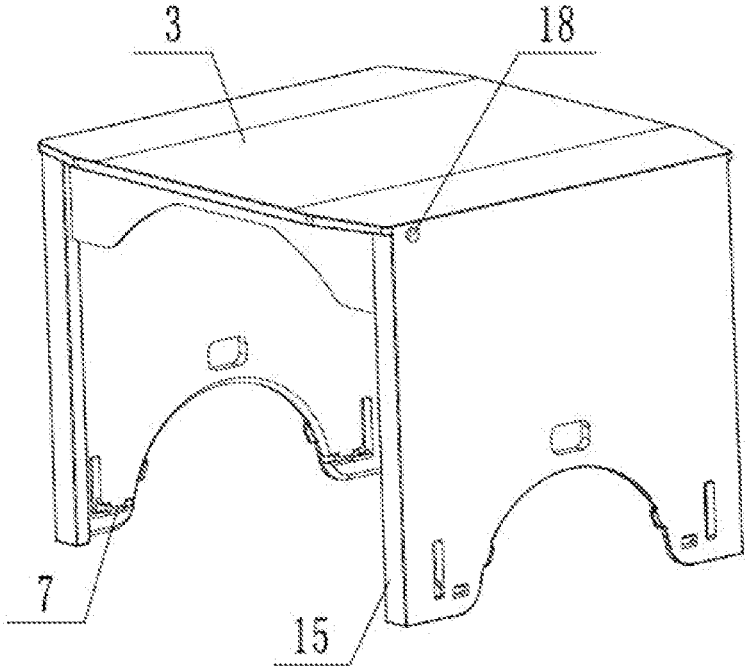
FIG. 7 is a schematic view showing the structure of a height adjusting block according to the present application.
Figure 8:
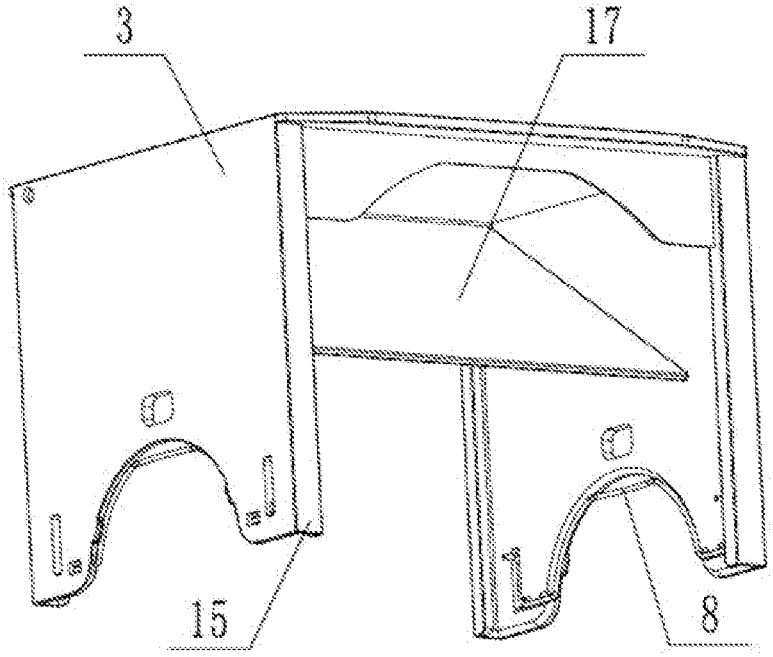
FIG. 8 is a schematic view showing the assembly of a height adjusting block according to the present application.
Figure 9:
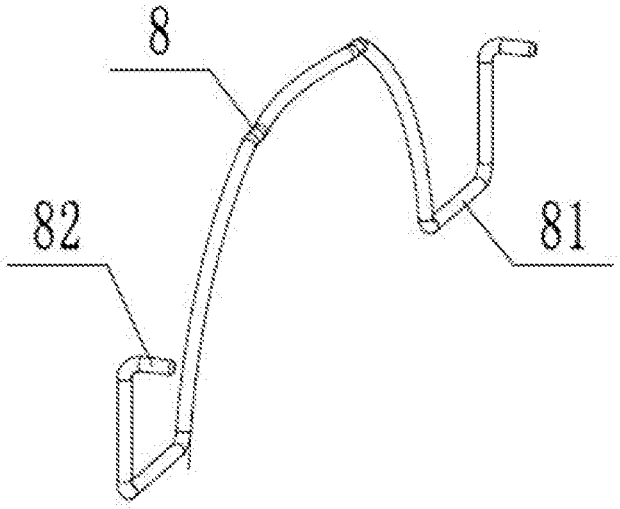
FIG. 9 is a schematic view showing the structure of a wire plug according to the present application.
Figure 10:
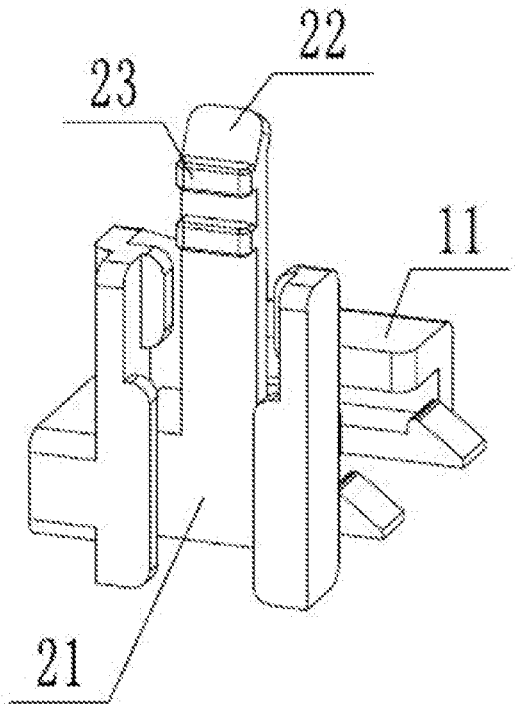
FIG. 10 is a schematic view showing the structure of a connector fixing seat according to the present application.
Figure 11:
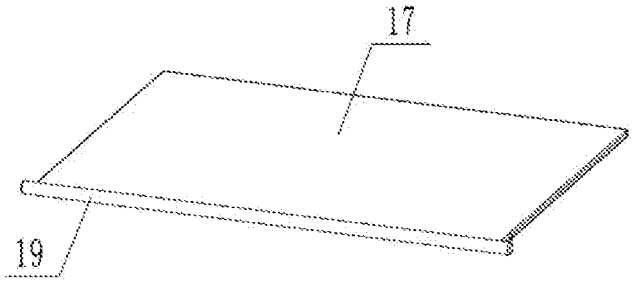
FIG. 11 is a schematic view showing the structure of a backflow preventing plate according to the present application.

Reference Numerals:

| | | | |
|---|---|---|---|
| 1 | fan box rear cover, | 2 | fan box front cover, |
| 3 | height adjusting block, | 4 | fan, |
| 5 | buckle, | 6 | slot, |
| 7 | trunking, | 8 | wire plug, |
| 81 | straight side, | 82 | fixing hook, |
| 9 | latching hole, | 10 | fan fixing hole, |
| 11 | connector fixing seat, | 12 | connector, |
| 13 | damping pad, | 14 | connecting hole, |
| 15 | right angle bending, | 16 | position scale, |
| 17 | backflow preventing plate, | 18 | rotating hole, |
| 19 | rotatable shaft, | 20 | fixing rail, |
| 21 | fixing sliding groove, | 22 | position stopping cantilever, |
| 23 | position stopping buckle, | 24 | position stopping slot |

DETAILED DESCRIPTION

Figure 13:
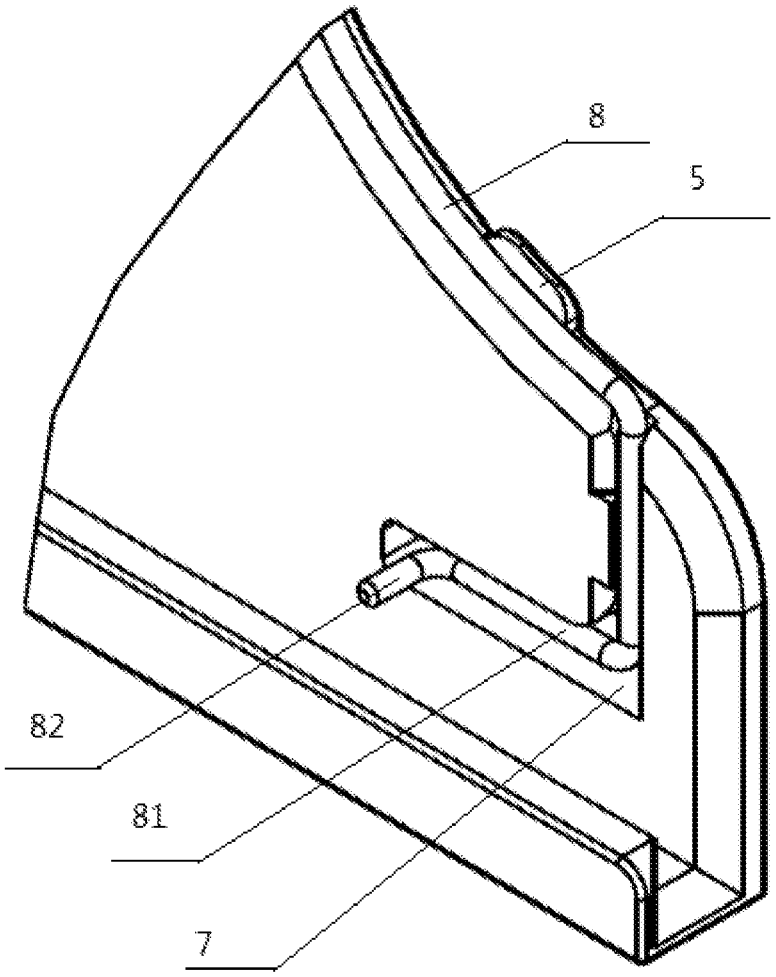
FIG. 13 is a partial enlarged view showing structures of a trunking and a wire plug according to the present application.

As shown in FIGS. 1 to 11, a height adjustable fan fixing structure is provided, which includes a fan box rear cover 1, a fan box front cover 2, the fan box rear cover 1 and the fan box front cover 2 are engaged to fix a fan 4. The structure further includes a height adjusting block 3, and the height adjusting block 3 is installed on the whole structure after the fan box rear cover 1 and the fan box front cover 2 being connected and is adjustable, a trunking 7 is provided at a lower end of each side of two sides of the height adjusting block 3, a rotatable wire plug 8 is provided in the trunking 7 (as show in FIG. 13), and the fan box rear cover 1 and the fan box front cover 2 are provided with latching holes 9 at positions corresponding to both ends of the wire plug 8, and the both ends of the wire plug 8 are inserted into the latching holes 9. The structure further includes a connector fixing seat 11, and the connector fixing seat 11 is fixed to a connector 12, and is installed on the fan box rear cover 1 and is adjustable.

The fan box rear cover 1 is provided with a buckle 5, the fan box front cover 2 is provided with a slot 6 at a position corresponding to the buckle 5, and the buckle 5 is engaged to the slot 6 for fixing. The fan box front cover 2 and the fan box rear cover 1 are connected by the engagement of the buckle 5 and the slot 6, which is convenient for connection. The fan 4 is located between the fan box front cover 2 and the fan box rear cover 1 to limit the fan 4 in a horizontal direction; the fan box rear cover 1 and the fan box front cover 2 are made of engineering plastic PC+ABS.

A damping pad 13 is respectively provided between the fan box rear cover 1 and the fan 4 and between the fan box front cover 2 and the fan 4, and the damping pad 13 is made of silicone rubber. The four corners at two sides of the fan 4 are provided with connecting holes 14, and eight connecting holes 14 are provided. The fan box rear cover 1 and the fan box front cover 2 are provided with fan fixing holes 10 at positions corresponding to the connecting holes 14 provided at the four corners of the fan 4. Eight damping pads 13 are provided. The eight damping pads 13 respectively pass through the fan fixing holes 10 on the fan box rear cover 1 and the fan box front cover 2, and the connecting holes 14 at the four corners of the fan 4. The damping pads 13 can damp the fan 4 to reduce the effects of vibration of the fan 4 on the system; the damping pads 13 position the fan 4 in the vertical direction.

The periphery of the height adjusting block 3 is provided with a right angle bending 15, the right angle bending 15 is engaged with the fan box rear cover 1 and the fan box front cover 2. The right angle bending 15 is engaged with four vertical sides of the whole formed by the connection of the fan box rear cover 1 and the fan box front cover 2. A middle of the wire plug 8 is of an arc shape, two ends of the wire plug 8 are respectively provided with a straight side 81, and two ends of the straight side 81 are provided with fixing hooks 82 perpendicular to a plane of the wire plug 8, and the fixing hooks 82 are engaged with the latching holes 9. When the height adjusting block 3 is required to be adjusted, the middle arc portion of the wire plug 8 is pulled. At this time, the straight sides 81 at the two ends of the wire plug 8 are rotated in the trunking 7, and the fixing hooks 82 are protruded from the latching holes 9, and then the height adjusting block 3 is adjusted to a suitable position, and the wire plug 8 is rotated to make the fixing hooks 82 engage with the latching holes 9 to latch the height adjusting block 3, which achieves tool-free operation and is simple and convenient, and the latching is firm. The height adjusting block 3 can be made of engineering plastic PC+ABS.

The fan box rear cover 1 is provided with a position scale 16 in a vertical direction. During the adjustment of the position of the height adjusting block 3, the position scale 16 can serve as a reference, making the position adjustment more accurate.

The height adjusting block 3 is provided with a backflow preventing plate 17, an upper end of the height adjusting block 3 is provided with a rotating hole 18, a front end of the backflow preventing plate 17 is provided with a rotatable shaft 19, and the backflow preventing plate 17 is rotatably connected to the height adjusting block 3 through the rotatable shaft 19 and the rotating shaft hole 18. When the height adjusting block 3 is pulled up, the backflow preventing plate 17 is rotated and opened by gravity to block the blank area above the fan 4, and the backflow of the airflow is blocked to prevent heat from backflowing due to the pulling up of the height adjusting block 3, which affects heat dissipation. The backflow preventing plate 17 may be made of engineering plastic PC+ABS.

The fan box rear cover 1 is provided with a fixing rail 20, the connector fixing seat 11 is provided with a fixing sliding groove 21, the fixing rail 20 is engaged with the fixing sliding groove 21, an upper end of the connector fixing seat 11 is provided with a position stopping cantilever 22, the position stopping cantilever 22 is provided with a position stopping buckle 23, the fixing sliding groove 21 is provided with a position stopping slot 24 in the vertical direction, and the position stopping buckle 23 is engaged with the position stopping slot 24.

The connector fixing seat 11 is made of nylon plus glass fiber PA66+GF.

Figure 12:
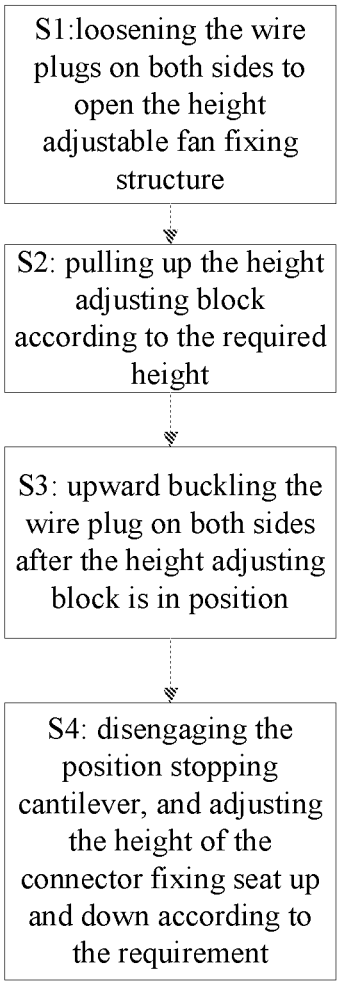
FIG. 12 is a flow chart of a method for adjusting the height of a fan module according to the present application.

As shown in FIG. 12, a method for adjusting the height of a fan module, which utilizes the above height adjustable fan fixing structure and includes:

S1: loosening the wire plugs 8 on both sides to open it, in which the wire plugs 8 on the left and right side is rotated outward and disengaged;

S2: pulling up the height adjusting block 3 according to the required height;

S3: upward buckling the wire plugs 8 on both sides after the height adjusting block 3 is in position, in which the height adjusting block 3 is aligned with the fan box and slide in from top to bottom, after the height adjusting block 3 reaches the required height, the wire plugs 8 on the left and right side are buckled, and as a spare part, the height adjustable hot-plugging fan module can be quickly replaced to chassis of different height application scenarios;

S4: disengaging the position stopping cantilever 22 on the connector fixing seat 11, and adjusting the height of the connector fixing seat 11 up and down according to the requirement, wherein after the adjustment is completed, the position stopping cantilever 22 is released, so that the position stopping buckle 23 is engaged with the position stopping slot 24.

In step S2, the height adjusting block is adjusted according to the position scale 16 on the fan box rear cover 1 during the adjustment.

The installation process of the fan module is: the eight damping pads 13 are installed into the fan fixing hole 10. The fan box front cover 2 and the fan box rear cover 1 are fastened by four buckles 5 to fix the fan 4. The connector fixing seat 11 slides into the fixing rail 20 on the fan box rear cover 1 after alignment, and installation is completed. The height can be adjusted according to the configuration by disengaging the position stopping cantilever 22. The fan connector 12 is pushed into the connector fixing seat 11. The wire plug 8 and the backflow preventing plate 17 are assembled to the height adjusting block 3 and the wire plugs 8 on the left and right side are rotated outward and disengaged. The height adjusting block 3 slides in from top to bottom the fan box after alignment, and the wire plugs 8 on the left and right side are fastened after the height adjusting block 3 reaching the required height.

The embodiments of the present disclosure are described above in conjunction with the drawings. However, the embodiments are not intended to limit the present disclosure, and various modifications or variations made by those skilled in the art based on the embodiments fall within the protection scope of the present disclosure.

The invention claimed is:

1. A height adjustable fan fixing structure, comprising:

a fan box rear cover, a fan box front cover, a height adjusting block, and a connector fixing seat, wherein the fan box rear cover and the fan box front cover are engaged to fix a fan, and the height adjusting block is installed on a whole structure after the fan box rear cover and the fan box front cover being connected and is adjustable, a trunking is provided at lower ends of each of two sides of the height adjusting block, a movable wire plug is provided in the trunking, and the fan box rear cover and the fan box front cover are provided with latching holes at positions corresponding to both ends of the wire plug, and the both ends of the wire plug are inserted into the latching holes; and wherein the connector fixing seat is fixed to a connector, and is installed on the fan box rear cover and is adjustable.

2. The height adjustable fan fixing structure according to claim 1, wherein the fan box rear cover is provided with a buckle, the fan box front cover is provided with a slot at a position corresponding to the buckle, and the buckle is engaged to the slot for fixing.

3. The height adjustable fan fixing structure according to claim 2, wherein a damping pad is respectively provided between the fan box rear cover and the fan and between the fan box front cover and the fan, and the damping pad is made of silicone rubber.

4. The height adjustable fan fixing structure according to claim 1, wherein periphery of the height adjusting block is provided with a right angle bending, the right angle bending is engaged with the fan box rear cover and the fan box front cover, a middle of the wire plug is of an arc shape, the two ends of the wire plug are respectively provided with a straight side, and two ends of the straight side are provided with fixing hooks perpendicular to a plane of the wire plug, and the fixing hooks are engaged with the latching holes.

5. The height adjustable fan fixing structure according to claim 4, wherein the fan box rear cover is provided with a position scale in a vertical direction.

6. The height adjustable fan fixing structure according to claim 1, wherein the height adjusting block is provided with a backflow preventing plate, an upper end of the height adjusting block is provided with a rotating hole, a front end of the backflow preventing plate is provided with a rotatable shaft, and the backflow preventing plate is rotatably connected to the height adjusting block through the rotatable shaft and the rotating shaft hole.

7. The height adjustable fan fixing structure according to claim 1, wherein the fan box rear cover is provided with a fixing rail, the connector fixing seat is provided with a fixing sliding groove, the fixing rail is engaged with the fixing sliding groove, an upper end of the connector fixing seat is provided with a position stopping cantilever, the position stopping cantilever is provided with a position stopping buckle, the fixing sliding groove is provided with a position stopping slot in the vertical direction, and the position stopping buckle is engaged with the position stopping slot.

8. The height adjustable fan fixing structure according to claim 7, wherein the connector fixing seat is made of nylon plus glass fiber PA66+GF.

9. A method for adjusting the height of a fan module, which utilizes a height adjustable fan fixing structure according to claim 1, comprising:

S1: pulling a middle arc portion of the wire plug, to move the wire plug out of the trunking;

S2: pulling up the height adjusting block according to the required height;

S3: inserting the wire plug into the trunking after the height adjusting block is in position; and S4: disengaging the position stopping cantilever on the connector fixing seat, and adjusting the height of the connector fixing seat up and down according to the requirement.

10. The method for adjusting the height of the fan module according to claim 9, wherein in step S2, the height adjusting block is adjusted according to the position scale on the fan box rear cover during the adjustment.

* * * * *